US009011163B2

(12) United States Patent
Ohsaka

(10) Patent No.: US 9,011,163 B2
(45) Date of Patent: Apr. 21, 2015

(54) COAXIAL ELECTRICAL CONNECTOR

(71) Applicant: Dai-Ichi Seiko Co., Ltd., Kyoto-shi (JP)

(72) Inventor: Junji Ohsaka, Tokyo (JP)

(73) Assignee: Dai-Ichi Seiko Co., Ltd., Kyoto-shi (JP)

( * ) Notice: Subject to any disclaimer, the term of this patent is extended or adjusted under 35 U.S.C. 154(b) by 36 days.

(21) Appl. No.: 13/855,929

(22) Filed: Apr. 3, 2013

(65) Prior Publication Data

US 2013/0280954 A1 Oct. 24, 2013

(30) Foreign Application Priority Data

Apr. 23, 2012 (JP) ..... 2012-097339

(51) Int. Cl.

| | |
|---|---|
| ***H01R 12/00*** | (2006.01) |
| ***H01R 13/40*** | (2006.01) |
| ***H01R 9/05*** | (2006.01) |
| ***H01R 12/57*** | (2011.01) |
| ***H01R 13/11*** | (2006.01) |
| ***H01R 24/50*** | (2011.01) |
| *H01R 103/00* | (2006.01) |
| *H01R 12/70* | (2011.01) |

(52) U.S. Cl.

CPC ..... *H01R 13/40* (2013.01); *H01R 9/05* (2013.01); *H01R 12/57* (2013.01); *H01R 13/11* (2013.01); *H01R 24/50* (2013.01); *H01R 2103/00* (2013.01); *H01R 12/7082* (2013.01)

(58) Field of Classification Search

USPC ..... 439/63, 581

See application file for complete search history.

(56) References Cited

U.S. PATENT DOCUMENTS

| | | | | |
|---|---|---|---|---|
| 7,097,480 | B2 * | 8/2006 | Fukuzaki et al. | 439/188 |
| 7,118,383 | B2 * | 10/2006 | Nagata et al. | 439/63 |
| 7,484,965 | B2 * | 2/2009 | Chien et al. | 439/63 |
| 7,651,335 | B2 * | 1/2010 | Chen | 439/63 |
| 7,758,377 | B2 * | 7/2010 | Maruyama | 439/582 |
| 8,657,608 | B2 * | 2/2014 | Tsai et al. | 439/63 |
| 8,678,836 | B2 * | 3/2014 | Kenzaki et al. | 439/63 |
| 2005/0159022 | A1 * | 7/2005 | Nagata | 439/63 |

FOREIGN PATENT DOCUMENTS

| | | | |
|---|---|---|---|
| DE | 19528552 | A1 | 2/1996 |
| EP | 1557914 | A1 | 7/2005 |

(Continued)

OTHER PUBLICATIONS

Office Action issued Oct. 21, 2014 in European Patent Application No. 13164214.2-1801.

*Primary Examiner* — Neil Abrams

(74) *Attorney, Agent, or Firm* — Oblon, McClelland, Maier & Neustadt, L.L.P.

(57) ABSTRACT

An annular contact is enabled to be firmly retained by an insulating housing without affecting the mating force or removing force between there and a matching connector with a simple configuration. Divided end parts of the annular contact attached to the insulating housing are provided with contact retaining parts that abut part of the insulating housing and retain the annular contact at the insulating housing when removal with respect to the matching connector is carried out, so that the shapes and sizes of the contact retaining parts are not affected by elastic force of the annular contact, in other words, mating force or removing force with respect to the matching connector almost at all to facilitate adjustment of the mating force or removing force between there and the matching connector.

3 Claims, 14 Drawing Sheets

(56) References Cited

FOREIGN PATENT DOCUMENTS

| | | |
|---|---|---|
| EP | 1622233 A1 | 2/2006 |
| EP | 1923961 A2 | 5/2008 |
| JP | 58-30290 | 2/1983 |
| JP | 7-42039 | 7/1995 |
| JP | 2006-066384 | 3/2006 |
| JP | 2009-104836 | 5/2009 |

* cited by examiner

COAXIAL ELECTRICAL CONNECTOR

BACKGROUND OF THE INVENTION

1. Field of the Invention

The present invention relates to a coaxial electrical connector in which an annular contact is attached to an insulating housing.

2. Description of Related Art

Generally, in various electrical devices, a pair of electrical connectors configured to be able to be mated/connected with each other has been widely used to electrically connect a signal transmission medium of various types such as a thin coaxial cable or a flexible wiring board to a printed wiring board or to electrically connect a pair of wiring boards (board to board) to each other. As such a pair of electrical connectors, for example, a plug connector (first connector), which is to be coupled to a signal transmission medium or a wiring board, and a receptacle connector (second connector), which is to be mounted on a wiring board, as described in Japanese Patent Application Laid-Open No. 2006-66384 are used; and electrical connection is configured to be established when the receptacle connector and the plug connector are mated with each other.

On the other hand, as the electrical connector used in connection of the above described pair of wiring boards (board to board) to each other, a coaxial electrical connector in which a contact is concentrically disposed is known. The coaxial electrical connector has a configuration in which an annular contact is attached to an insulating housing, and the annular contact is divided in a circumferential direction via a dividing slit provided at part in the circumferential direction of the annular contact. When mating or removal is to be carried out with a matching connector, the annular contact undergoes elastic deformation while divided end parts of the annular contact opposed to each other in the circumferential direction via the above described dividing slit are separated from each other in the circumferential direction, in other words, while the distance of the dividing slit is expanded. When the elastic deformation is carried out so as to increase the distance of the dividing slit of the annular contact in this manner, the outer diameter of the annular contact is somewhat expanded; however, at the point when the mating operation or the removing operation is completed, the annular contact is configured to recover to the original state so that both of the connectors are retained in a mated state or a released state.

However, recently, as reduction in the size/height of the electrical connectors has been advanced, the necessity of firmly retaining the annular contact at the insulating housing against removing force between there and the matching connector has been increasing. For example, Japanese Patent Application Laid-Open No. 2006-66384 employs a configuration in which an engagement projection 15 formed on an outer periphery of the insulating housing (plug body) is engaged with an opening formed in the annular contact (external conductor), and movement of the annular contact with respect to the insulating housing is configured to be regulated by such a configuration.

However, in the electrical connector disclosed in that document, the opening is formed in the annular contact (external conductor); therefore, the elasticity of the annular contact is varied depending on the shape and size of forming the opening, and the mating force or removing force between there and the matching connector is affected, the mating force or removing force with respect to the matching connector has to be adjusted so as to be appropriate as part of product performance. However, when the opening is provided in the annular contact in the above described manner, the shape and size of the opening have to be set depending on the relative relation with the material of a metal material constituting the annular contact. As a result, there has been a problem that it is difficult to cause the mating force or removing force with respect to the matching connector to be appropriate.

We disclose prior art that we are aware of to be materials for the examination of the application as follows.

[Unexamined Publication Gazette 1] JP 2006-66384 A

BRIEF SUMMARY OF THE INVENTION

Therefore, it is an object of the present invention to provide a coaxial electrical connector capable of firmly retaining an annular contact at an insulating housing by a simple configuration without affecting the mating force or removing force between there and the matching connector.

In order to achieve the above described object, the present invention employs a configuration in which a coaxial electrical connector has an annular contact attached to an insulating housing, the annular contact provided with a dividing slit dividing the annular contact in a circumferential direction, the annular contact having divided end parts opposed to each other in a circumferential direction via the dividing slit, the divided end parts configured to be close to or separated from each other in the circumferential direction when mating/removal is carried out between the connector and a matching connector; wherein the divided end parts of the annular contact are provided with a contact retaining part that abuts part of the insulating housing and retains the annular contact at the insulating housing when removal with respect to the matching connector is to be carried out.

According to the coaxial electrical connector having such a configuration, the contact retaining part, which causes the annular contact to be retained by the insulating housing, is provided at the divided end parts, which constitute the dividing slit of the annular contact. Therefore, the shape and the size of the contact retaining part do not affect the elastic force of the annular contact, in other words, the mating force or removing force with respect to the matching connector almost at all, and the mating force or removing force between there and the matching connector is easily adjusted.

Herein, in the present invention, it is desired to be configured so that the contact retaining part provided on the annular contact has axial-direction retaining surfaces that face the part of the insulating housing in a direction of the removal; and the insulating housing is provided with a first projecting part that faces the axial-direction retaining surfaces of the annular contact in the direction of the removal.

According to the coaxial electrical connector having such a configuration, when removal from the matching connector is carried out, the axial-direction retaining surfaces constituting the contact retaining part of the annular contact abut the first projecting part of the insulating housing, thereby directly retaining the insulating housing and the annular contact in the direction of the removal.

Furthermore, in the present invention, it is desired to be configured so that the contact retaining part provided on the annular contact has radial-direction retaining surfaces that face the part of the insulating housing in a radial direction of the annual contact; and the insulating housing is provided with second projecting parts that face the radial-direction retaining surfaces of the annular contact in the radial direction.

According to the coaxial electrical connector having such a configuration, when removal from the matching connector is carried out, the radial-direction retaining surfaces, which are the contact retaining part of the annular contact, abut the second projecting parts of the insulating housing, thereby preventing the mating force or removing force between there and the matching connector from becoming excessively small since radial-direction expansion of the annular contact is stopped, and adjustment is easily carried out.

As described above, in the coaxial electrical connector according to the present invention, the divided end parts of the annular contact attached to the insulating housing are provided with the contact retaining part, which abut the part of the insulating housing and retain the annular contact at the insulating housing when removal with respect to the matching connector is carried out so that the shape and size of the contact retaining part do not affect the elastic force of the annular contact, in other words, the mating force or removing force with respect to the matching connector almost at all to configure that adjustment of the mating force or removing force between there and the matching connector can be easily adjusted. Therefore, with the simple configuration, the annular contact can be firmly retained at the insulating housing without affecting the mating force or removing force between there and the matching connector, and reliability of the coaxial electrical connector can be significantly enhanced at low cost.

DETAILED DESCRIPTION OF THE INVENTION

Figure 1:
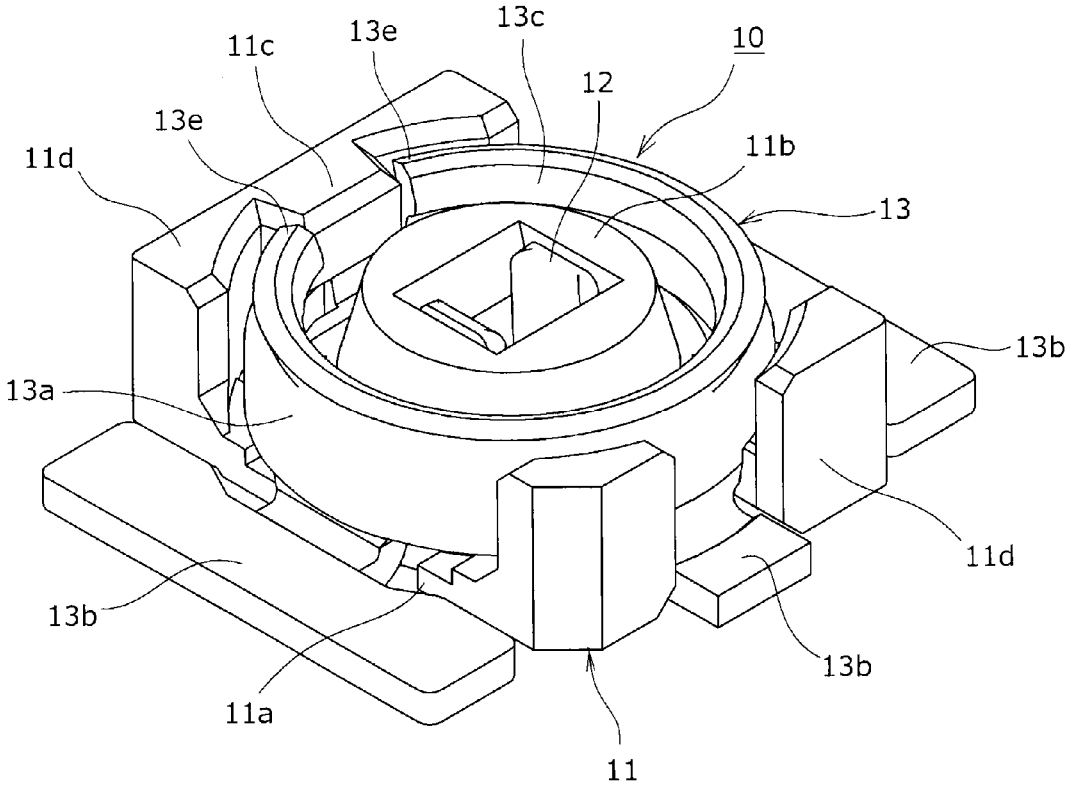
FIG. 1 is an external perspective explanatory view showing a coaxial electrical connector according to an embodiment of the present invention from the upper side.
Figure 2:
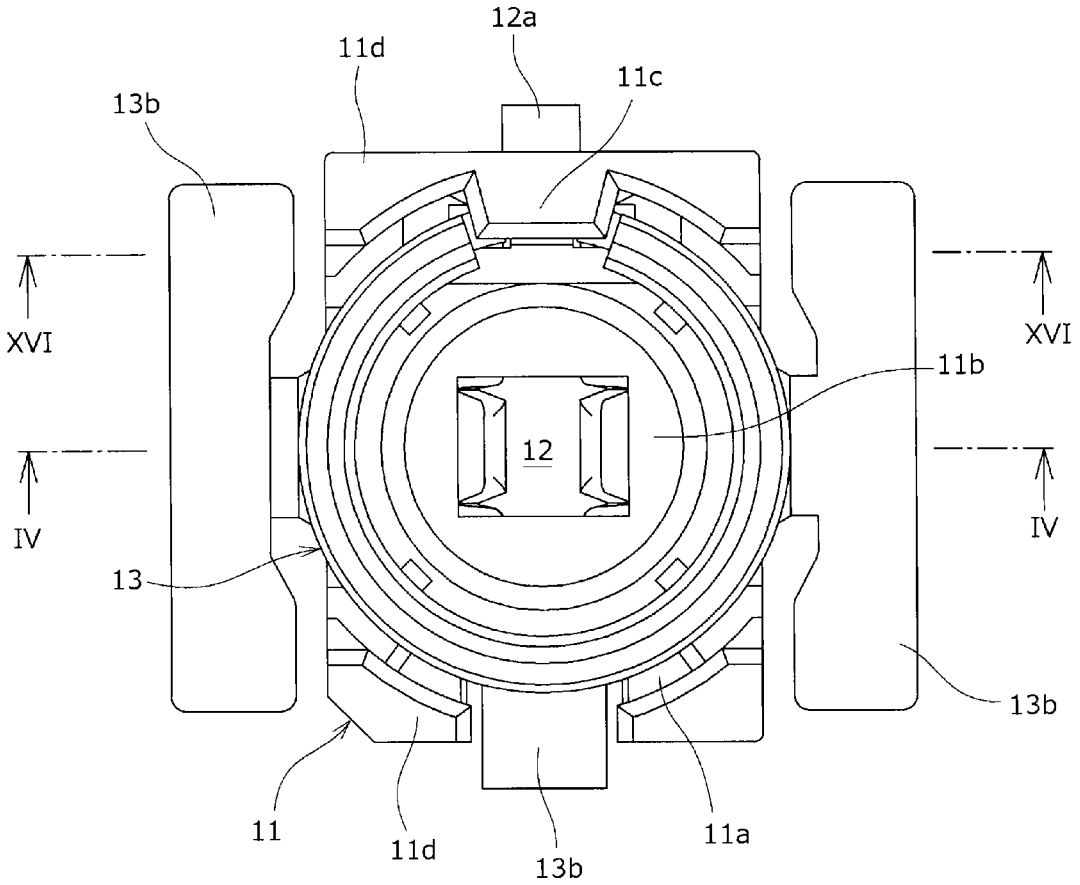
FIG. 2 is a plan explanatory view of the coaxial electrical connector according to the embodiment of the present invention shown in FIG. 1.
Figure 3:
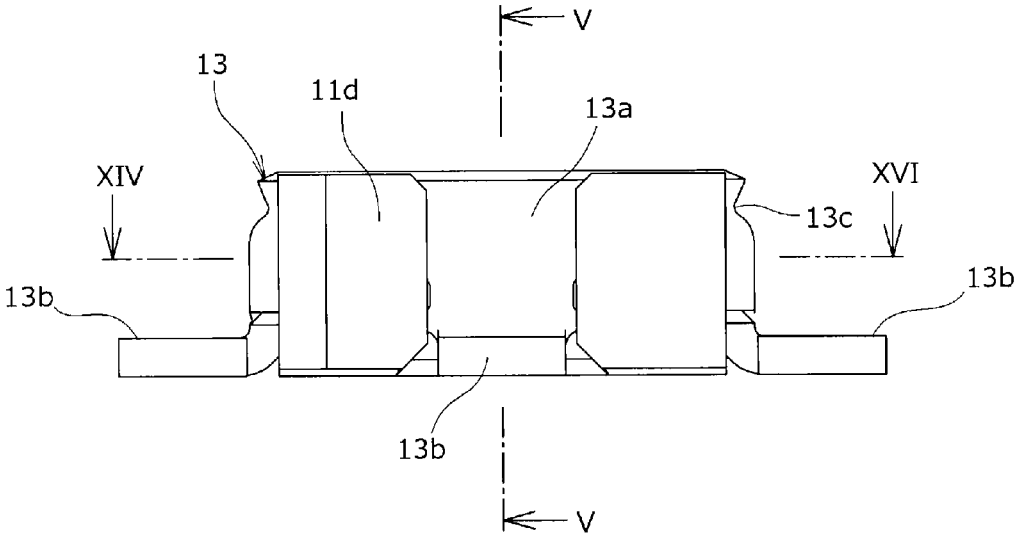
FIG. 3 is a front explanatory view of the coaxial electrical connector according to the embodiment of the present invention shown in FIG. 1 and FIG. 2.

Hereinafter, an embodiment in which the present invention is applied to a coaxial electrical connector, which is to connect printed wiring boards to each other, will be explained in detail based on drawings.

[About Overall Structure]

A coaxial electrical connector 10 according to the embodiment of the present invention shown in FIG. 1 to FIG. 16 is, for example, to be mounted by soldering on a printed wiring board P disposed in an electronic device such as a mobile phone. While the coaxial electrical connector 10 is being held by a hand of an operator, the coaxial electrical connector 10 is disposed in the upper side of the drawings coaxially with respect to another coaxial electrical connector 20 serving as a matching connector (see FIG. 12, FIG. 13); and, when the coaxial electrical connector 10 is thrust toward the coaxial electrical connector 20 in the lower side of the drawings with appropriate force, both of the connectors 10 and 20 are caused to be in a mutually mated state. When the coaxial electrical connector 10 according to the embodiment of the present invention is held and pulled up to the upper side of the drawings with appropriate force from the mated state of both of the connectors 10 and 20, removal is carried out so that the coaxial electrical connector 10 according to the embodiment of the present invention is detached to the upper side of the drawings from the coaxial electrical connector 20 serving as the matching connector.

Inserting/removing operations of the above described coaxial electrical connector 10 are not limited to be carried out by hands of an operator, but may be automatically carried out by a machine. Hereinafter, the inserting direction and the removing direction of the coaxial electrical connector 10 will be referred to as "downward direction" and "upward direction", respectively. The configuration of the single body of the coaxial electrical connector 10 will be explained by showing a top-bottom reversed state.

[About Configuration of Insulating Housing]

An insulating housing 11 constituting a main body part of the above described coaxial electrical connector 10 is, for example, formed by molding by using a resin material such as plastic, and the insulating housing 11 integrally has a base frame 11*a* to be placed on the printed wiring board P and a center frame 11*b* consisting of an approximately-cylindrical hollow body projecting upward from a center-side part of the base frame 11*a*. The center frame 11*b* therein is formed so as to form part of a conical shape of which inner diameter is continuously reduced toward the upper side. In a center part from the base frame 11*a* to the center frame 11*b*, contact housing space is formed so as to penetrate therethrough in an axial direction (vertical direction), and a later-described signal contact 12 for signal transmission is attached in the contact housing space.

Moreover, a ground contact 13 for grounding is attached to the above described base frame 11*a* so as to surround the center frame 11*b* at the center side from the outer side thereof.

The ground contact 13 corresponds to an annular contact of the present invention and is formed so as to have an approximately annular shape in a plane, and detailed structures thereof will be explained later.

[About Configuration of Signal Contact]

Figure 5:
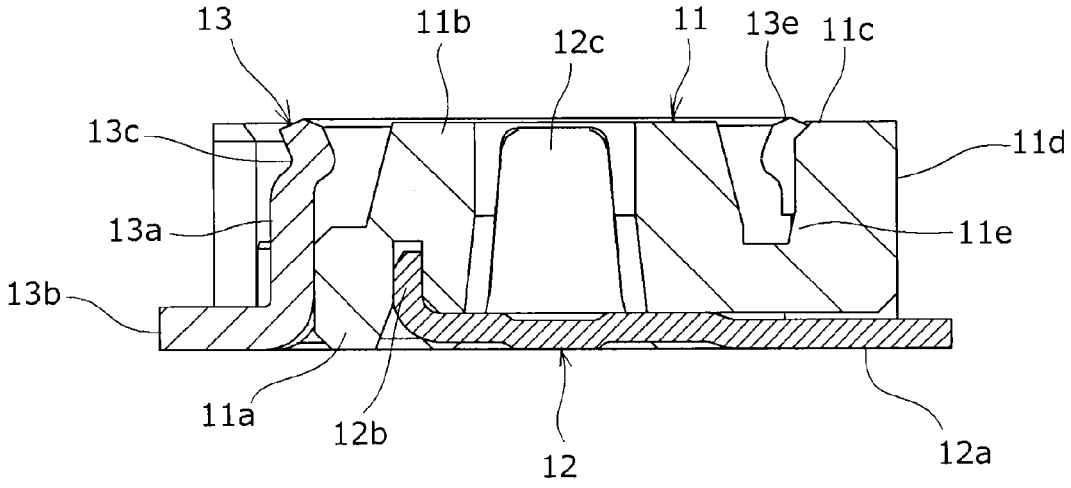
FIG. 5 is a vertical cross-sectional explanatory view along a line V-V in FIG. 3.
Figure 6:
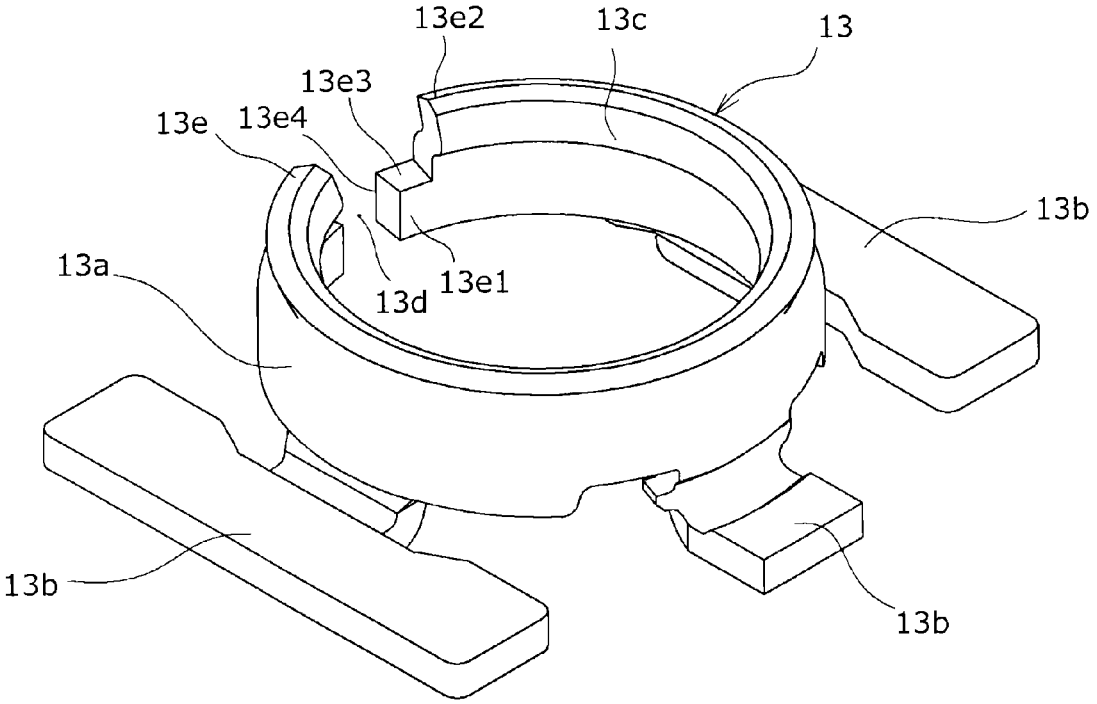
FIG. 6 is an external perspective explanatory view showing a single structure of an annular contact used in the coaxial electrical connector according to the embodiment of the present invention shown in FIG. 1 to FIG. 5.
Figure 7:
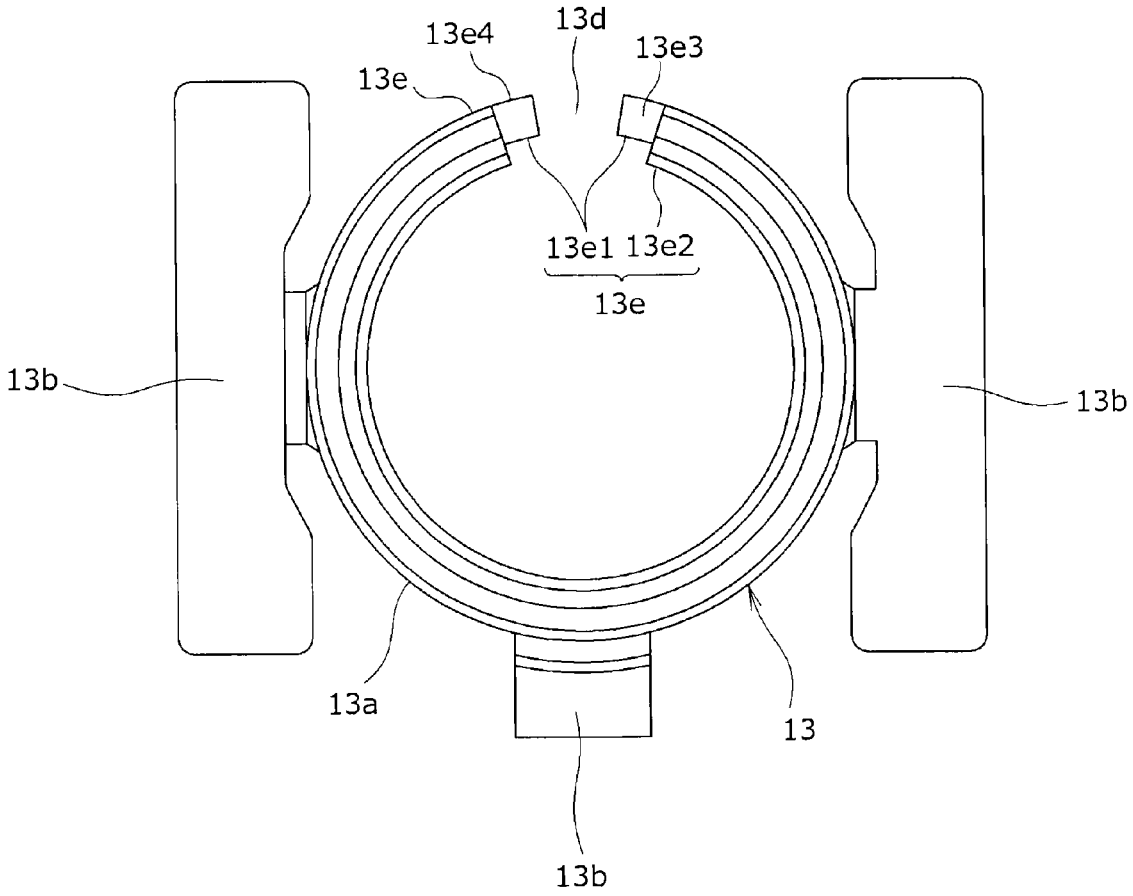
FIG. 7 is a plan explanatory view of the annular contact shown in FIG. 6.
Figure 8:
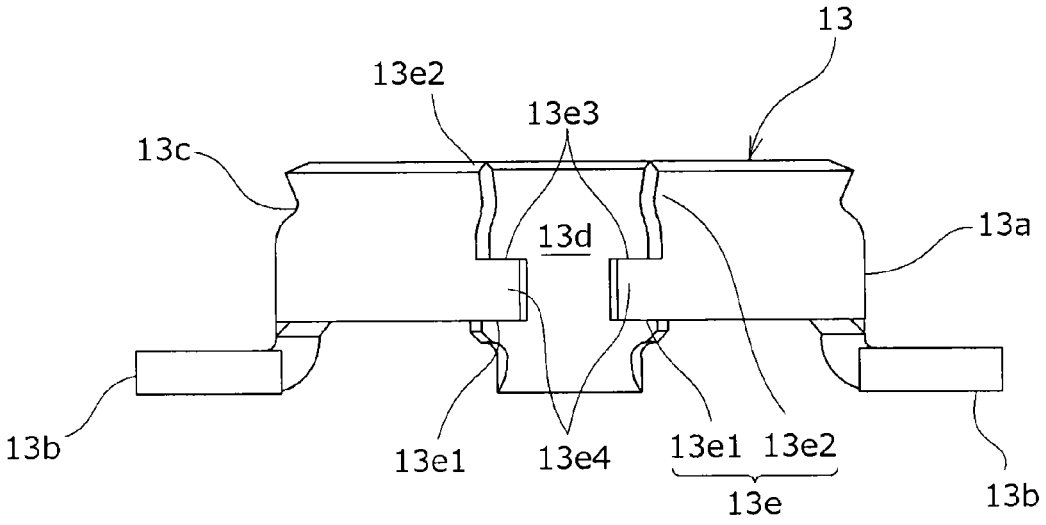
FIG. 8 is a back explanatory view of the annular contact shown in FIG. 6.
Figure 9:
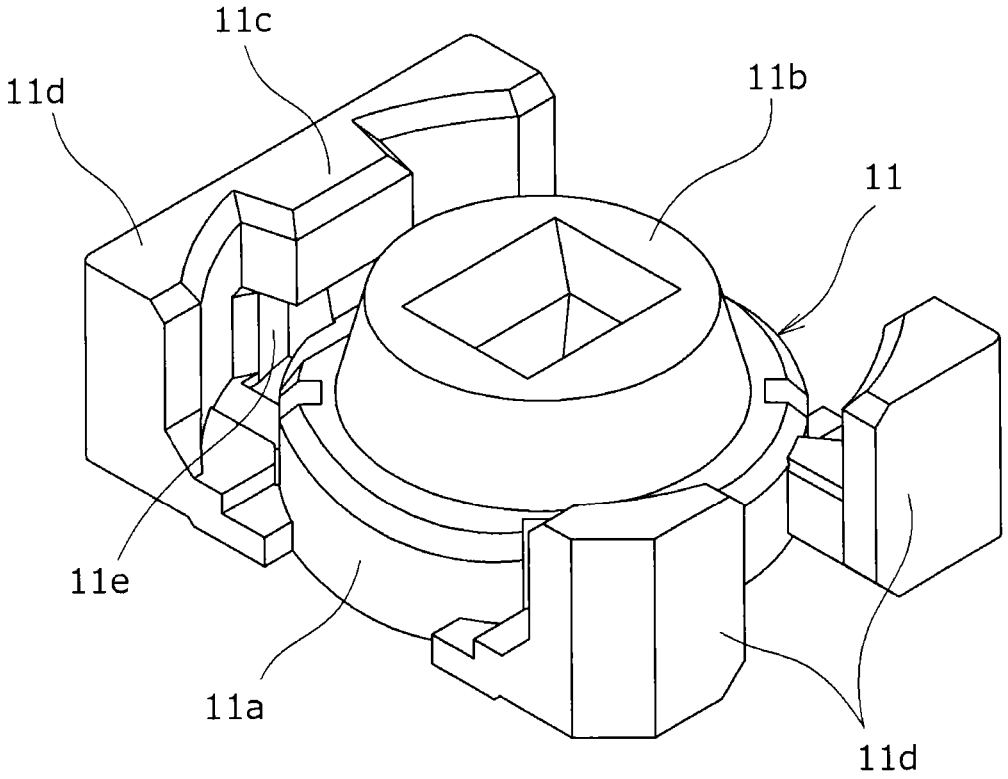
FIG. 9 is an external perspective explanatory view showing a single structure of the insulating housing used in the coaxial electrical connector according to the embodiment of the present invention shown in FIG. 1 to FIG. 5.
Figure 10:
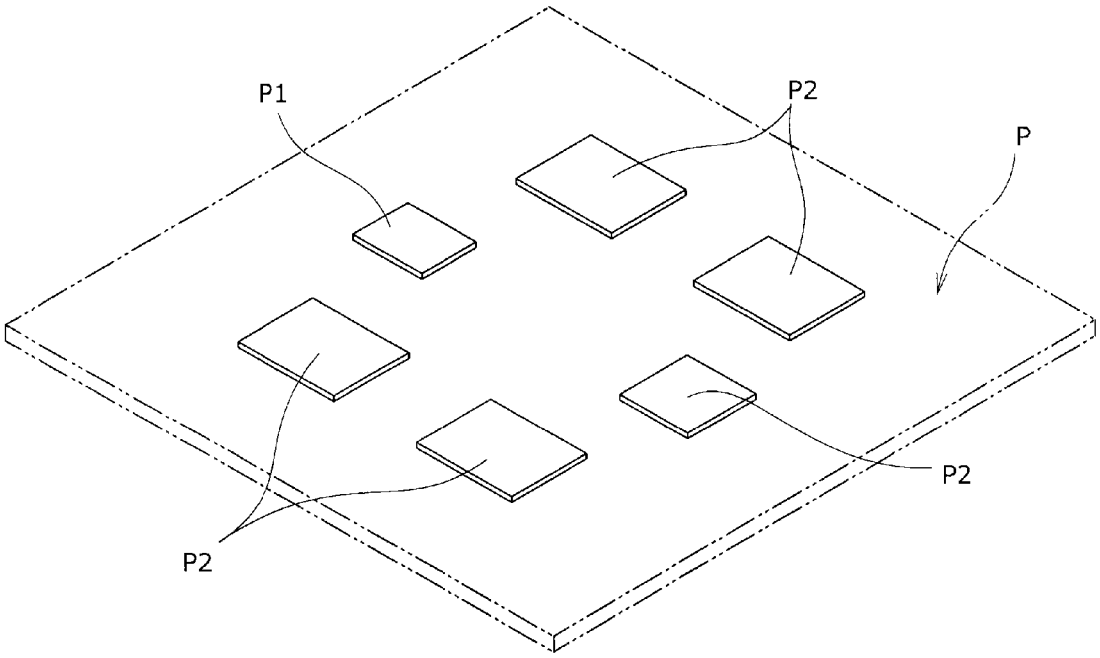
FIG. 10 is an external perspective explanatory view showing disposed structures of contact parts provided on a printed wiring board on which the coaxial electrical connector according to the embodiment of the present invention shown in FIG. 1 to FIG. 5 is to be mounted.
Figure 11:
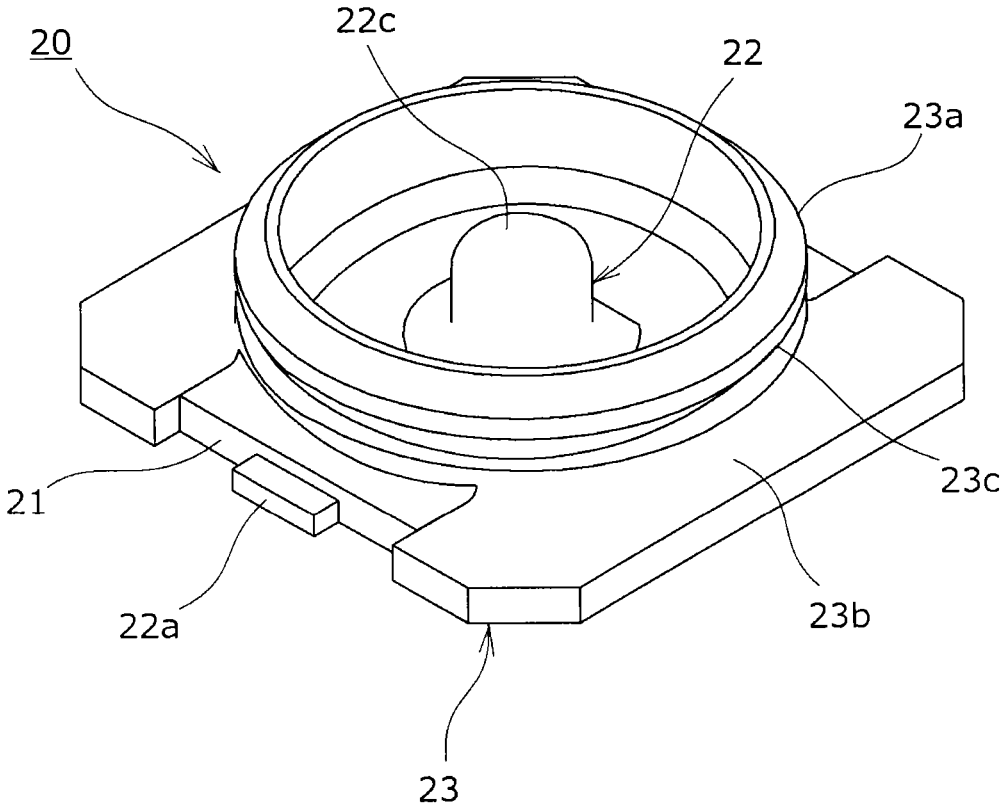
FIG. 11 is an external perspective explanatory view showing an example of a matching connector to be mated with the coaxial electrical connector according to the embodiment of the present invention shown in FIG. 1 to FIG. 5.

The signal contact 12 is formed from a predetermined thin metal member and has a connecting leg part 12*a*, which is joined by soldering on an electrically-conductive signal path P1 formed on the printed wiring board P, as shown in FIG. 10. The connecting leg part 12*a* is approximately horizontally extended to form a band-plate-like shape from the outer side of the insulating housing 11 toward the inner side thereof. As shown in FIG. 5, at a distal end part in an extended side thereof, a fixing piece 12*b*, which is formed by bending toward the upper side approximately at a right angle, is press-fitted into the base frame 11*a* of the insulating housing 11 from the bottom-surface side.

Figure 4:
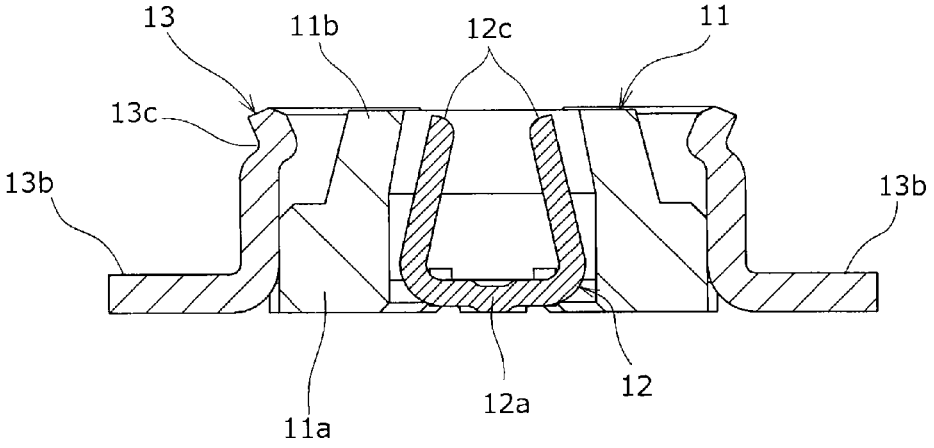
FIG. 4 is a vertical cross-sectional explanatory view along a line IV-IV in FIG. 2.

At the part to which the above described connecting leg part 12*a* is extended to the center part of the insulating housing 11, a pair of mating contact parts 12*c*, 12*c* is integrally continued thereto so as to rise upward from both-side edge parts of the connecting leg part 12*a*. The paired mating contact parts 12*c*, 12*c* are in an arrangement relation so as to face each other and are inclined so that the distance between both of the mating contact parts 12*c*, 12*c* is continuously reduced toward the upper side. When the mating contact parts 12*c*, 12*c* are viewed from a lateral side, an upper-side open structure having an approximately trapezoidal shape in a vertical cross section as shown in FIG. 4 is formed. A mating contact part 22*c* of a signal contact 22 provided on the other coaxial electrical connector 20 serving as the matching connector, which will be described later, is configured to be mated (see FIG. 13) in the narrow space formed at an upper-end position between both of the mating contact parts 12*c*, 12*c*.

[About Configuration of Ground Contact]

On the other hand, the ground contact 13 constituting the annular contact of the present invention is formed from, for example, a bent member of a predetermined thin metal plate and has a ground main body part 13*a*, which is formed so as to form an approximately-cylindrical hollow shape. At an outer-periphery lower edge part of the ground main body part 13*a* forming the annular shape, a plurality of (three) connecting leg parts 13*b* integrally extended toward the radially outer side are configured to be joined by soldering with electrically-conductive ground paths P2 (see FIG. 10) formed on the printed wiring board P.

At an upper-edge outer-peripheral part of the ground main body part 13*a* constituting the ground contact (annular contact) 13, an annular engaging part 13*c* bulging to the inner side in the radial direction is formed by drawing. The annular engaging part 13*c* of the ground contact 13 is in an elastically mated state (see FIG. 13) with respect to an annular latch part 23*c* provided in the later-described other coaxial electrical connector 20 serving as the matching connector.

In the ground main body part 13*a* of the ground contact (annular contact) 13, a dividing slit 13*d* dividing the ground main body part 13*a* with respect to the circumferential direction is formed at one location thereof in the circumferential direction. Between divided end parts 13*e*, 13*e* of the ground main body part 13*a*, the dividing slit 13*d* consists of a groove-like gap extending in the axial direction (vertical direction) of the annular shape which is the direction of mating/removal. The divided end parts 13*e*, 13*e* of the ground main body part 13*a* are disposed so as to face each other in the circumferential direction via the dividing slit 13*d*. The divided end parts 13*e*, 13*e* of the ground main body part 13*a* are configured to be moved so as to be separated or be close to each other as elastic deformation of the ground main body part 13*a* is carried out in the circumferential direction or radial direction.

Furthermore, each of the above described divided end parts 13*e*, 13*e* of the ground main body part 13*a* is formed so as to have a shape of steps toward the axial direction (vertical direction) of the ground main body part 13*a*, and the step part thereof is provided with a contact retaining part, which abuts part of the insulating housing 11 upon removal of the other coaxial electrical connector (matching connector) 20. The contact retaining part will be explained in detail. First, each of the divided end parts 13*e*, 13*e* of the ground main body part 13*a* opposed to each other in the circumferential direction via the above described dividing slit 13*d* has a lower-half projecting part 13*e*1, which is disposed in the lower side in the axial direction (vertical direction) of the ground contact (annular contact) 13, and an upper-half recessed part 13*e*2, which is disposed in the upper side in the axial direction (vertical direction).

The lower-half projecting parts 13*e*1 of the divided end parts 13*e* are disposed so as to be projected in the circumferential direction and be close to each other, and the upper-half recessed parts 13*e*2 are somewhat retracted in the circumferential direction and disposed at positions away from each other. The stepped surface in the circumferential direction formed between the lower-half projecting part 13*e*1 and the upper-half recessed part 13*e*2 thereof is an axial-direction retaining surface 13*e*3 serving as the contact retaining part. The axial-direction retaining surface (contact retaining part) 13*e*3 provided on the ground contact (annular contact) 13 in this manner is in an arrangement relation in which the retaining surface faces the first projecting part 11*c*, which is provided on the insulating housing 11, in the axial direction (vertical direction).

The first projecting part 11*c* provided on the insulating housing 11 is formed to have a beam member shape extended from an inner wall surface of an outer-shell wall part 11*d*, which rises from an outer edge part of the above described base frame 11*a*, toward the connector center side. The first projecting part 11*c* is formed so that a transverse cross-sectional shape thereof orthogonal to the radial direction, which is the extending direction of the first projecting part 11*c*, is formed to have an approximately rectangular shape; and the first projecting part 11*c* is inserted so as to be in a loosely mated state in the part between the upper-half recessed parts 13*e*2, 13*e*2, which constitute the divided end parts 13*e*, 13*e* of the above described ground main body part 13*a*, in other words, in an upper-side expanded region of the above described dividing slit 13*d*. The axial-direction retaining surface 13*e*3 of the ground contact 13 is disposed so as to be brought into contact with the lower surface of the first projecting part 11*c*, which is provided on the insulating housing 11, from the lower side.

Figure 14:
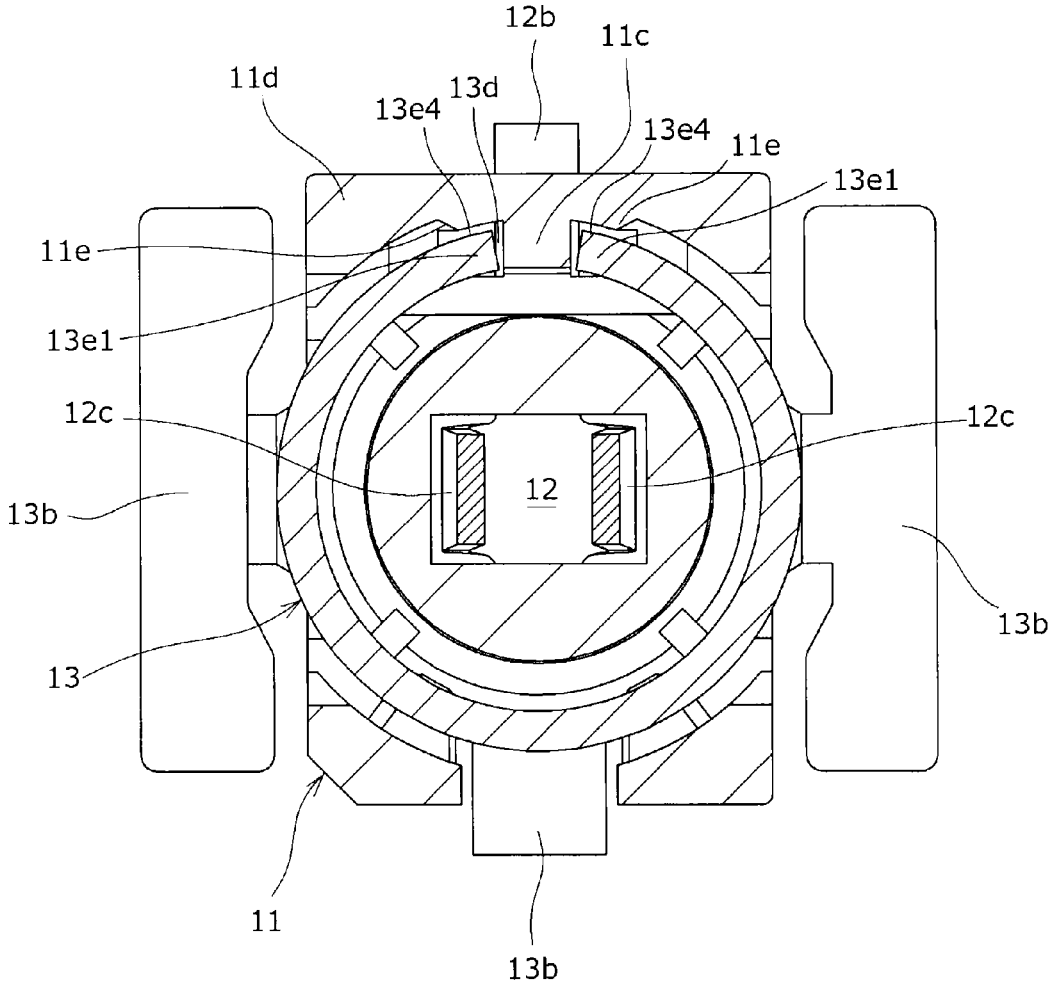
FIG. 14 is a horizontal cross-sectional explanatory view of both of the connectors in the mated state shown in FIG. 13.

Furthermore, particularly as shown in FIG. 14, the outer peripheral surface of the lower-half projecting part 13*e*1 constituting the divided end part 13*e* of the above described ground main body part 13*a* serves as a radial-direction retaining surface 13*e*4, which faces the inner wall surface of the outer-shell wall part 11*d* of the insulating housing 11 in the radial direction. The radial-direction retaining surface 13*e*4 constitutes the contact retaining part together with the above described axial-direction retaining surface 13*e*3. The inner wall surface of the outer-shell wall part 11*d* of the insulating housing 11 is provided with a second projecting part 11*e*, which is to face, in the radial direction, the radial-direction retaining surface 13*e*4 from the outer side of the radial direction.

Figure 15:
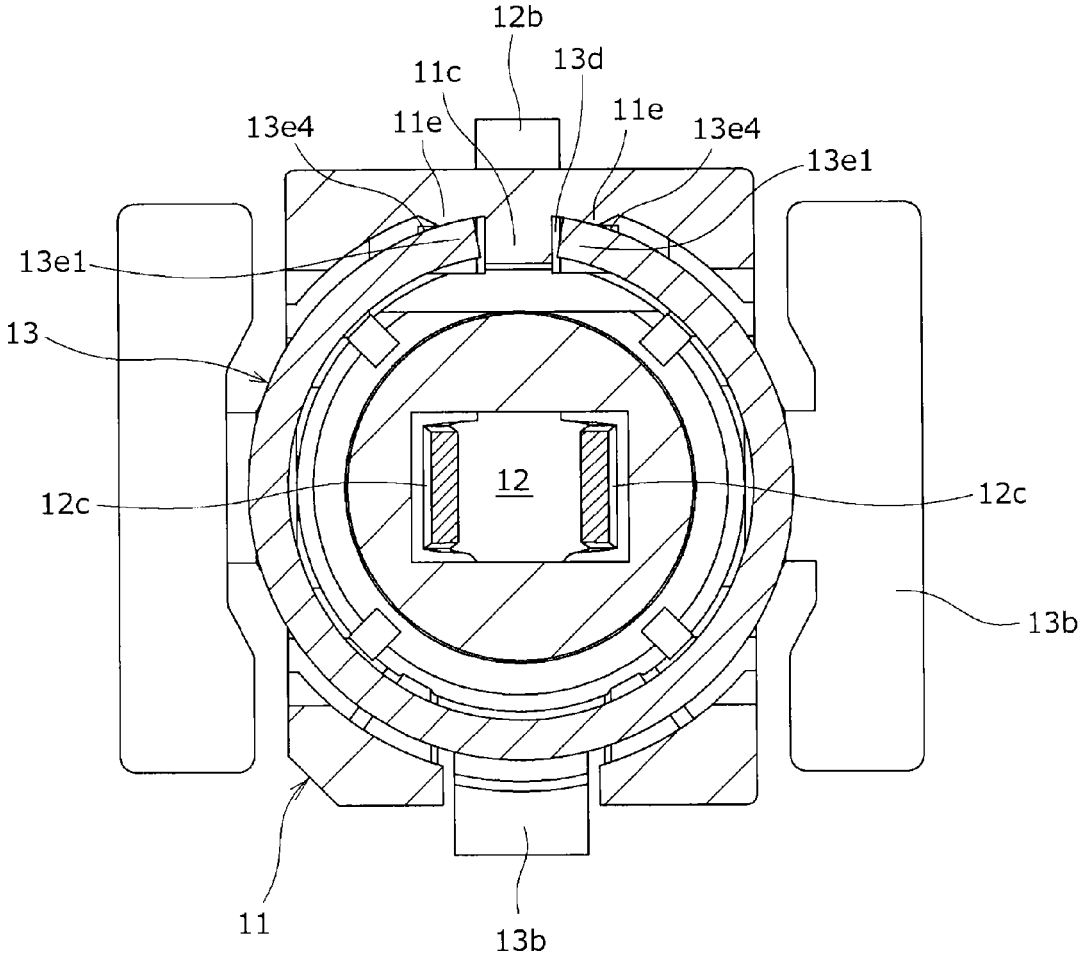
FIG. 15 is a horizontal cross-sectional explanatory view corresponding to FIG. 14 showing an intermediate state of removing both of the connectors from each other which are in the mated state shown in FIG. 14.
Figure 16:
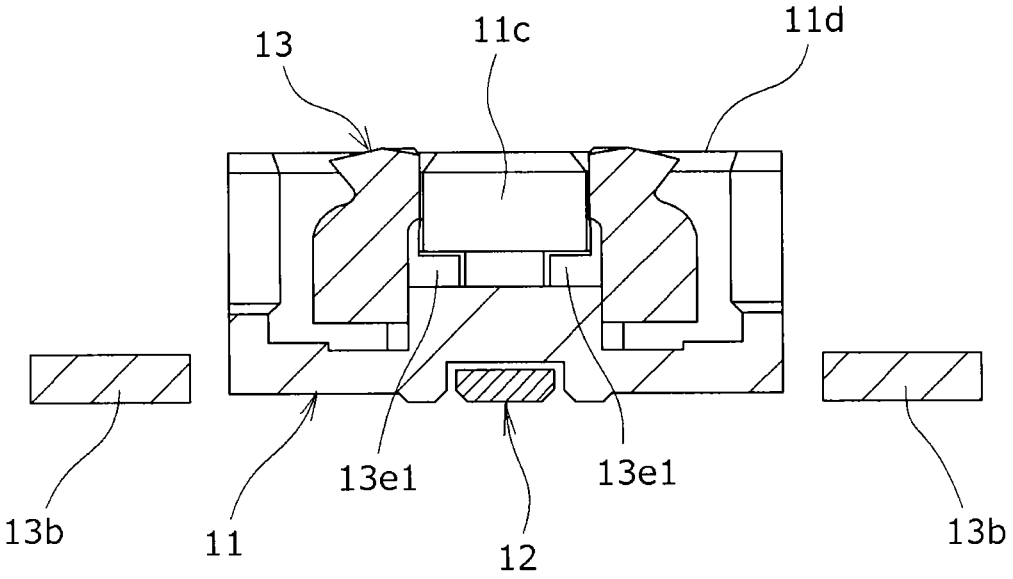
FIG. 16 is a vertical cross-sectional explanatory view along a line XVI-XVI in FIG. 2.

The second projecting part 11*e* has a stepped shape projecting from the outer-shell wall part 11*d* of the base frame 11*a* of the above described insulating housing 11 toward the center side, and the inner wall surface which is the projecting-side distal-end surface of the second projecting part 11*e* is disposed to be opposed to the outer peripheral surface, in other words, the radial-direction retaining surface 13*e*4 of the lower-half projecting part 13*e*1 of the divided end part 13*e* of the ground main body part 13*a* from the outer side so as to have a predetermined gap therebetween. As shown in FIG. 15, when a mating operation with respect to the later-described other coaxial electrical connector (matching connector) 20 is carried out, as the outer diameter of the ground main body part 13*a* is increased, the radial-direction retaining surfaces 13*e*4 of the ground main body part 13*a* are moved to the outer side of the radial direction and abut the inner wall surfaces of the second projecting parts 11*e* of the insulating housing 11 from the inner side. As a result, the entire ground contact (annular contact) 13 is regulated so as not to be expanded more than that in the radial direction.

[About Overall Configuration of Matching Connector]

Figure 12:
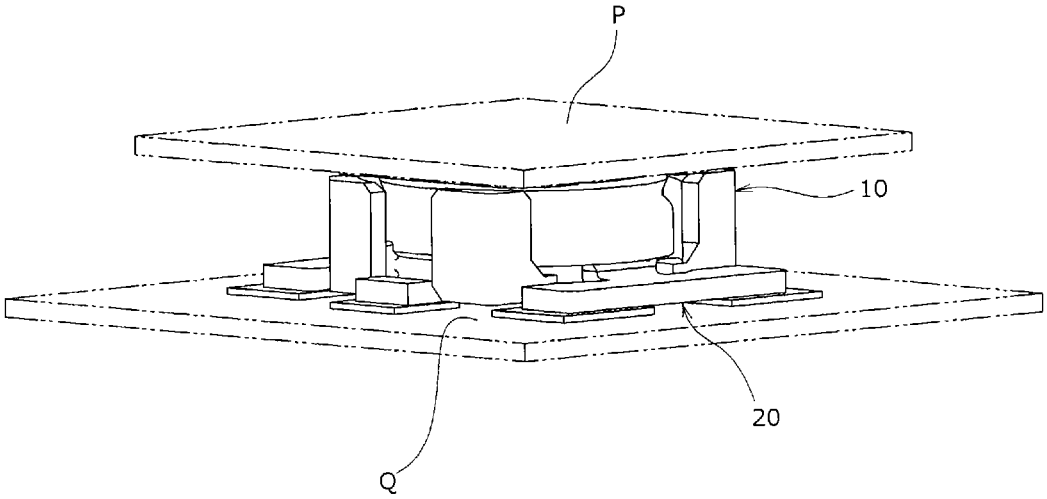
FIG. 12 is an external perspective explanatory view showing a mating completed state after the coaxial electrical connector according to the embodiment of the present invention shown in FIG. 1 to FIG. 5 has been mated with the matching connector.
Figure 13:
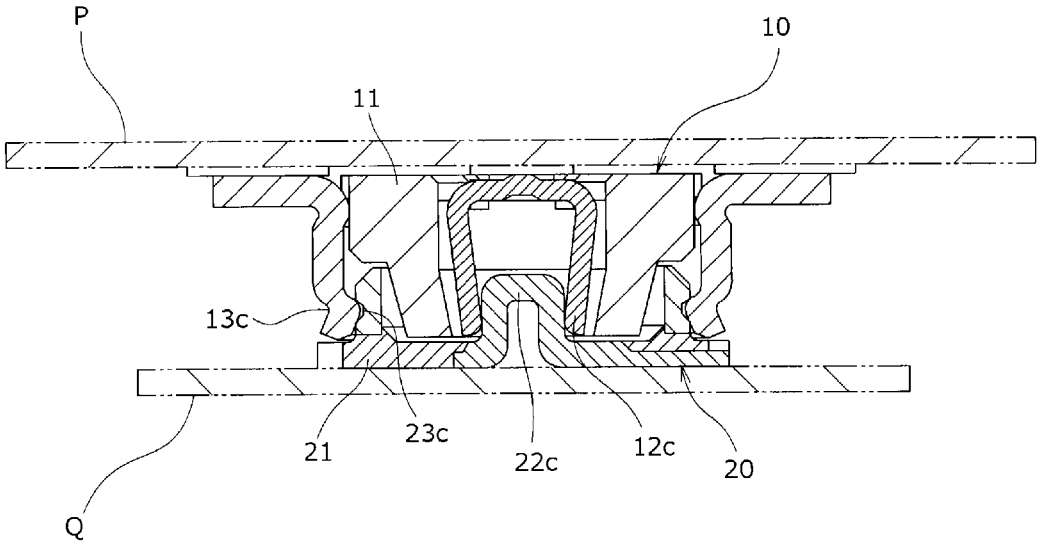
FIG. 13 is a vertical cross-sectional explanatory view of both of the connectors in the mated state shown in FIG. 12.

As shown in FIG. 12 and FIG. 13, the cylindrical connector 10 according to the embodiment of the present invention having such a configuration is configured to be mated with the other coaxial electrical connector 20 serving as the matching connector from the upper side and be removed therefrom toward the upper side. The matching connector 20 in this process is also approximately similarly configured; therefore, each of the members having similar configurations is shown by replacing "1" in the tenth place with "2", and different configurations will be explained below.

First, an insulating housing 21 provided on the other coaxial electrical connector 20 is formed from a flat-plate-like member having an approximately rectangular shape in a plane, and the signal contact 22 for signal transmission projecting from a center part of the insulating housing 21 is attached thereto. A ground contact 23 for grounding is attached so as to surround the signal contact 22 from the outer side.

[About Configuration of Signal Contact]

The signal contact 22 is formed from, for example, a bent member of a predetermined thin metal plate and has a connecting leg part 22*a* to be joined by soldering with an electrically-conductive signal path (illustration omitted) formed on a printed wiring board Q. The connecting leg part 22*a* is extended to the center side of the insulating housing 21, and the mating contact part 22*c* having a hollow pin shape projecting so as to rise upward approximately at a right angle from the center part thereof is integrally continued therefrom. The above described mating contact part 12*c* provided in the coaxial electrical connector 10 according to the present invention is configured to be mated (see FIG. 13) with the mating contact part 22*c* so as to cover it from the outer side.

[About Configuration of Ground Contact]

The ground contact 23 provided in the coaxial electrical connector 20 is also formed from, for example, a bent member of a predetermined thin metal plate, and a plurality of connecting leg parts 23*b* integrally extended toward the radial outer side from outer peripheral parts of the ground main body part 23*a*, which is formed to have an approximately-cylindrical hollow shape, are configured to be joined by soldering with electrically-conductive ground paths (illustration omitted) formed on the printed wiring board Q. The annular latch part 23*c* consisting of an annular groove is formed on an outer-peripheral upper edge part of the ground main body part 23*a*. The annular engaging part 13*c* of the above described cylindrical connector 10 according to the present invention is configured to be in an elastically mated state (see FIG. 13) with respect to the annular latch part 23*c* so as to cover it from the outer side.

The ground main body part 23*a* of the ground contact 23 is not provided with a dividing slit for circumferential-direction dividing like the ground contact 13 of the cylindrical connector 10 according to the present invention.

The above described coaxial electrical connector 10 according to the embodiment of the present invention is disposed above the other coaxial electrical connector 20 serving as the matching connector thereof so as to be opposed thereto in a downward reversed state as shown in FIG. 12 and FIG. 13; and, then, mating is carried out so as to thrust the connector downward. In the mating operation, the annular engaging part 13*c* of the coaxial electrical connector 10 abuts the annular latch part 23*c* of the other coaxial electrical connector 20 from the upper side to achieve a pressure-contact state; as a result, the ground main body part 13*a* of the ground contact (annular contact) 13 is elastically deformed in the direction in which it is expanded in the circumferential direction, and the divided end parts 13*e*, 13*e* of the ground main body part 13*a* are moved so as to be separated from each other in the circumferential direction.

When the mating operation between both of the connectors 10 and 20 is completed, the divided end parts 13*e*, 13*e* of the ground main body part 13*a* provided in the coaxial electrical connector 10 are moved so as to be close to each other again in the circumferential direction, the distance therebetween is returned to the original distance, and the ground main body part 13*a* is recovered in a contracting direction in the circumferential direction. Upon removal of the coaxial electrical connector 10, elastic displacement in a reverse direction of that of the above described step is carried out.

According to the coaxial electrical connector 10 having such a configuration, as the contact retaining part, which retains the ground contact (annular contact) 13 at the insulating housing 11, the divided end parts 13*e*, 13*e* constituting the dividing slit 13*d* of the ground contact 13 are provided with the axial-direction retaining surfaces 13*e*3 and the radial-direction retaining surfaces 13*e*4. When the coaxial electrical connector 10 is to be removed from the mated state with the other coaxial electrical connector 20 serving as the matching connector, the axial-direction retaining surfaces 13*e*3 of the ground contact 13 abut the first projecting part 11*c* of the insulating housing 11 from the lower side, thereby directly retaining the insulating housing 11 and the ground contact 13 in the axial direction, which is the direction of removal.

Upon connector removal, along with radial-direction expansion of the ground contact (annular contact) 13, the radial-direction retaining surfaces 13*e*4 also provided as the contact retaining part abut the second projecting part 11*e* of the insulating housing 11 from the inner side particularly as shown in FIG. 15; and, thereafter, excessive expansion of the ground contact 13 in the radial direction is regulated. As a result, the mating force or removing force with respect to the other coaxial electrical connector (matching connector) 20 is easily adjusted.

In this manner, in the present embodiment, the axial-direction retaining surfaces 13*e*3 and the radial-direction retaining surfaces 13*e*4 provided as the contact retaining part at the ground contact (annular contact) 13 are provided at the divided end parts 13*e* constituting the dividing slit 13*d* of the ground contact (annular contact) 13. Therefore, the shapes and sizes of the axial-direction retaining surfaces 13*e*3 and the radial-direction retaining surfaces 13*e*4 do not affect the mating force or removing force with respect to the other coaxial electrical connector (matching connector) 20 almost at all, and adjustment of the mating force or removing force with respect to the other coaxial electrical connector 20 is facilitated.

Hereinabove, the invention accomplished by the present inventor has been explained in detail based on the embodiment. However, the present invention is not limited to the above described embodiment, and it goes without saying that various modifications can be made within the range not departing from the gist thereof.

As described above, the present invention can be widely applied to various coaxial electrical connectors used in various electronic/electrical devices.

What is claimed is:

1. A coaxial electrical connector comprising;

an annular contact attached to an insulating housing, the annular contact provided with a dividing slit dividing the annular contact in a circumferential direction, the annular contact having divided end parts opposed to each other in a circumferential direction via the dividing slit, the divided end parts configured to be close to or separated from each other in the circumferential direction when mating/removal is carried out between the connector and a matching connector; wherein the divided end parts of the annular contact are provided with a contact retaining part that abuts part of the insulating housing and retains the annular contact at the insulating housing when removal with respect to the matching connector is to be carried out, the contact retaining part provided on the annular contact has axial-direction retaining surfaces that face the part of the insulating housing in a direction of the removal, the insulating housing is provided with a first projecting part that faces the axial-direction retaining surfaces of the annular contact in the direction of the removal, and the axial-direction retaining surfaces are formed in the divided end parts to have a shape of steps toward the axial direction of the annular contact.

2. The coaxial electrical connector according to claim 1, wherein the contact retaining part provided on the annular contact has radial-direction retaining surfaces that face the part of the insulating housing in a radial direction of the annual contact; and the insulating housing is provided with second projecting parts that face the radial-direction retaining surfaces of the annular contact in the radial direction.

3. A coaxial electrical connector comprising;

an annular contact attached to an insulating housing, the annular contact provided with a dividing slit dividing the annular contact in a circumferential direction, the annular contact having divided end parts opposed to each other in a circumferential direction via the dividing slit, the divided end parts configured to be close to or separated from each other in the circumferential direction when mating/removal is carried out between the connector and a matching connector; wherein the divided end parts of the annular contact are provided with a contact retaining part that abuts part of the insulating housing and retains the annular contact at the insulating housing when removal with respect to the matching connector is to be carried out, the contact retaining part provided on the annular contact has axial-direction retaining surfaces that face the part of the insulating housing in a direction of the removal, the insulating housing is provided with a first projecting part that faces the axial-direction retaining surfaces of the annular contact in the direction of the removal, the contact retaining part provided on the annular contact has radial-direction retaining surfaces that face the part of the insulating housing in a radial direction of the annual contact, and the insulating housing is provided with second projecting parts that face the radial-direction retaining surfaces of the annular contact in the radial direction.

* * * * *